US007980643B2

(12) United States Patent
Laible

(10) Patent No.: US 7,980,643 B2
(45) Date of Patent: Jul. 19, 2011

(54) REFRIGERATING DEVICE WITH PULL-OUT CARRIER FOR REFRIGERATED GOODS

(75) Inventor: Karl-Friedrich Laible, Langenau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 902 days.

(21) Appl. No.: 11/918,596

(22) PCT Filed: Mar. 30, 2006

(86) PCT No.: PCT/EP2006/061170

§ 371 (c)(1),
(2), (4) Date: Oct. 15, 2007

(87) PCT Pub. No.: WO2006/120075

PCT Pub. Date: Nov. 16, 2006

(65) Prior Publication Data

US 2009/0121599 A1 May 14, 2009

(30) Foreign Application Priority Data

May 10, 2005 (DE) ..... 10 2005 021 559

(51) Int. Cl.
*A47B 88/04* (2006.01)

(52) U.S. Cl. ..... 312/404; 312/334.8; 312/334.1

(58) Field of Classification Search ..... 312/330.1, 312/334.1, 334.7, 334.8, 334.11, 334.22, 312/350, 401, 402; 62/382; 384/18, 20, 384/22

See application file for complete search history.

(56) References Cited

U.S. PATENT DOCUMENTS

| | | | | |
|---|---|---|---|---|
| 2,318,363 | A | 5/1943 | Boddy | |
| 2,711,944 | A * | 6/1955 | Meek et al. | 312/333 |
| 3,320,003 | A * | 5/1967 | Edelson et al. | 384/35 |
| 3,650,578 | A * | 3/1972 | Del Vecchio et al. | 384/18 |
| 4,993,847 | A * | 2/1991 | Hobbs | 384/21 |
| 5,015,047 | A | 5/1991 | Nock | |
| 5,033,805 | A * | 7/1991 | Hobbs | 312/334.11 |
| 5,040,856 | A * | 8/1991 | Wilkins et al. | 312/402 |
| 2003/0173882 | A1 | 9/2003 | Koons | |

FOREIGN PATENT DOCUMENTS

| | | |
|---|---|---|
| EP | 0 367 274 | 5/1990 |
| WO | WO 2006/048307 | 5/2006 |

OTHER PUBLICATIONS

International Search Report PCT/EP2006/061170.

* cited by examiner

*Primary Examiner* — James O Hansen

(74) *Attorney, Agent, or Firm* — James F. Howard; Andre Pallapies

(57) ABSTRACT

A carrier for refrigerated goods is moved in the cooling chamber of a refrigerating device by means of two telescopic extensions. The carrier for refrigerated goods is held on each telescopic extension via an adapter. A contact surface of the adapter that supports the carrier for refrigerated goods lies above the level of the telescopic extensions.

15 Claims, 4 Drawing Sheets

REFRIGERATING DEVICE WITH PULL-OUT CARRIER FOR REFRIGERATED GOODS

The present invention relates to a refrigerator with a cooling compartment in which a carrier for refrigerated goods can be moved with the aid of telescopic extension mechanisms. The use of telescopic extension mechanisms for slidably mounting refrigerated goods carriers, which can be baskets, plates or the like, in a refrigerator is generally known. Such a telescopic extension mechanism generally comprises two interlocking rails which can be displaced relative to one another in the longitudinal direction by a roller mounted on the first rail rolling along the other rail.

In order to ensure linear guiding of the rails, both must be supported on one another at least two points spaced apart in their longitudinal direction. The distance between these points is reduced the further the rails are pulled apart, so that the stability of the telescopic rail mounting is reduced the further a refrigerated goods carrier mounted thereon is withdrawn from the refrigerator's cooling compartment. It is therefore necessary to limit the movability of the rails relative to one another such that the supporting points cannot come too close to one another. The freedom of movement of the rails is therefore generally much less than their length. Therefore it is also not possible using a simple two-rail telescopic extension mechanism to make the freedom of movement of the refrigerated goods carrier large enough to enable it to be completely withdrawn from the cooling compartment.

To achieve this objective, telescopic extension mechanisms with at least three rails moving relative to one another are required. These are therefore much more expensive than those with two rails. It is therefore not cost-effective for a manufacturer wishing to offer refrigerators in a wide range of prices and features to use three-rail telescopic extension mechanisms throughout. However, if the manufacturer's model range includes extension mechanisms with both two and three or more rails, the problem arises that the various types of telescopic extension mechanisms differ in terms of their space requirement. As the external dimensions of the refrigerators are specified in grid pattern steps and their wall thickness is not very variable, the different space requirement of the different types of telescopic extension mechanisms must be taken into account when designing the refrigerated goods carriers, i.e. different refrigerated goods carriers are required for different refrigerator models which differ in the types of extension mechanisms used. These therefore have to be manufactured in comparatively small quantities in a large number of types, which increases production costs.

The object of the present invention is to minimize the number of different parts required for manufacturing different refrigerator models, both those with a completely withdrawable refrigerated goods carrier and those with a partially withdrawable refrigerated goods carrier.

This object is achieved by a refrigerator with a cooling compartment in which a first refrigerated goods carrier can be moved using two telescopic extension mechanisms, whereby the refrigerated goods carrier is mounted on each telescopic extension mechanism with the aid of at least one adapter and an adapter contact surface supporting the refrigerated goods carrier is above the level of the telescopic extension mechanisms. By placing the contact surface higher than the telescopic extension mechanisms with the help of the adapter, it can to a large extent be positioned freely even in the widthwise direction of the refrigerator cabinet and, in particular, independently of the width of the telescopic extension mechanisms used, which enables uniform refrigerated goods carriers to be used in conjunction with telescopic extension mechanisms of different widths.

A maximum width of the refrigerated goods carrier and consequently good space utilization can be achieved if the contact surfaces of the adapters are spaced as far apart as possible on both sides of the refrigerated goods carrier, particularly if they at least partly extend perpendicularly above the telescopic extension mechanisms to which the relevant adapters are attached.

If the telescopic extension mechanisms used are narrow, particularly in the case of extension mechanisms with only two rails, the contact surface can also come to lie above an intervening space between telescopic extension mechanism and refrigerated goods container.

The width of said intervening space is preferably at least as large as that of the narrow telescopic extension mechanism itself, so that, if required, another telescopic extension mechanism of the same type can be mounted in line with the one present in order to increase the freedom of movement of the refrigerated goods container.

The adapter is preferably angular, with a vertical arm attached to the assigned telescopic extension mechanism and a horizontal arm comprising the contact surface.

For better stability, the horizontal arm can be supported directly on an upper side of the telescopic extension mechanism.

In order to facilitate the mounting of the refrigerated goods carrier in the refrigerator, the adapters are preferably provided with latching elements for engaging with a respective complementary latching element of the refrigerated goods carrier.

It is additionally preferred that the adapters each have a front and a rear latching element, said rear latching element being engageable with the complementary latching element of the first refrigerated goods carrier by a movement essentially parallel to the displacement direction of the first refrigerated goods carrier and said front latching element being engageable with the complementary latching element of the first refrigerated goods carrier by a movement essentially perpendicular to the displacement direction of the first refrigerated goods carrier. Thus the front latching element prevents unlatching if the refrigerated goods carrier is pulled only in the horizontal direction in order to withdraw it from the cooling compartment. Easy mounting of the refrigerated goods carrier is possible by first horizontally displacing the rear area of the refrigerated goods carrier which is initially held at angle, in order to cause the rear latching element to engage, and then lowering the front area in order to engage the front latching element also.

For this purpose the rear latching element of the adapters can be expediently embodied as an undercut rigid head and the thereto complementary latching element of the refrigerated goods carrier can be implemented as a slot which is open-edged in the displacement direction.

The front latching element, on the other hand, is preferably a head which is flexibly deformable when the complementary latching element is latched in and out.

This head can be provided with a side which is flexible in the displacement direction and which, in the latched state, holds the complementary latching element pressed against a stop, thereby holding the refrigerated goods carrier to the telescopic extension mechanism in a play-free manner. If the complementary latching element of the refrigerated goods carrier is a hole in which the head engages, the stop can be formed by a side facing away from said flexible side of the head.

The front and rear latching element are each preferably formed separately from one another on a front and rear adapter respectively of each telescopic extension mechanism. This two-part arrangement allows the same adapters to be used both on a right-hand and on a left-hand telescopic extension mechanism or even on telescopic extension mechanisms of different lengths.

In this case it is further preferred that the front and rear adapter each have a plane of symmetry perpendicular to the displacement direction of the refrigerated goods carrier, so that the two front adapters mounted on the right-hand or left-hand telescopic extension mechanism and the two rear adapters mounted on the right-hand and left-hand telescopic extension mechanism lie opposite one another as mirror images.

The freedom of movement of two rails movable relative to one another of each telescopic extension mechanism is preferably limited to less than two thirds of their length. A greater freedom of movement would be achievable in principle, but the torques then occurring between the rails in the maximally pulled-apart condition would require a high degree of rail strength and therefore occasion a considerable material expense that would increase the costs. Such a large freedom of movement of the individual telescopic extension mechanism is not required within the scope of the present invention, for it is preferable to use two telescopic extension mechanisms connected in-line in order to achieve a greater freedom of movement.

Refrigerated goods carriers supported via individual telescopic extension mechanisms and refrigerated goods carriers supported via telescopic extension mechanisms connected in-line can be combined in one and the same refrigerator.

The form and disposition of the complementary latching elements of the two refrigerated goods carriers are preferably identical in such a case. This means that it is possible, for example, to install at least one of the two refrigerated goods carriers in place of the other.

To simplify manufacture it may be useful for each refrigerated goods carrier to be formed of a plurality of parts, namely a base body and two carrier sections attached to said base body, the complementary latching elements being formed on the carrier sections. This allows in particular the base body to be sheet metal formed, while the carrier portions can be e.g. injection molded.

In order to ensure that the refrigerated goods carrier is guided with little play, the two rails of each telescopic extension mechanism are preferably movably guided relative to one another using linear ball bearings.

Further features and advantages of the invention will emerge from the following description of exemplary embodiments with reference to the accompanying drawings in which.

Figure 1:
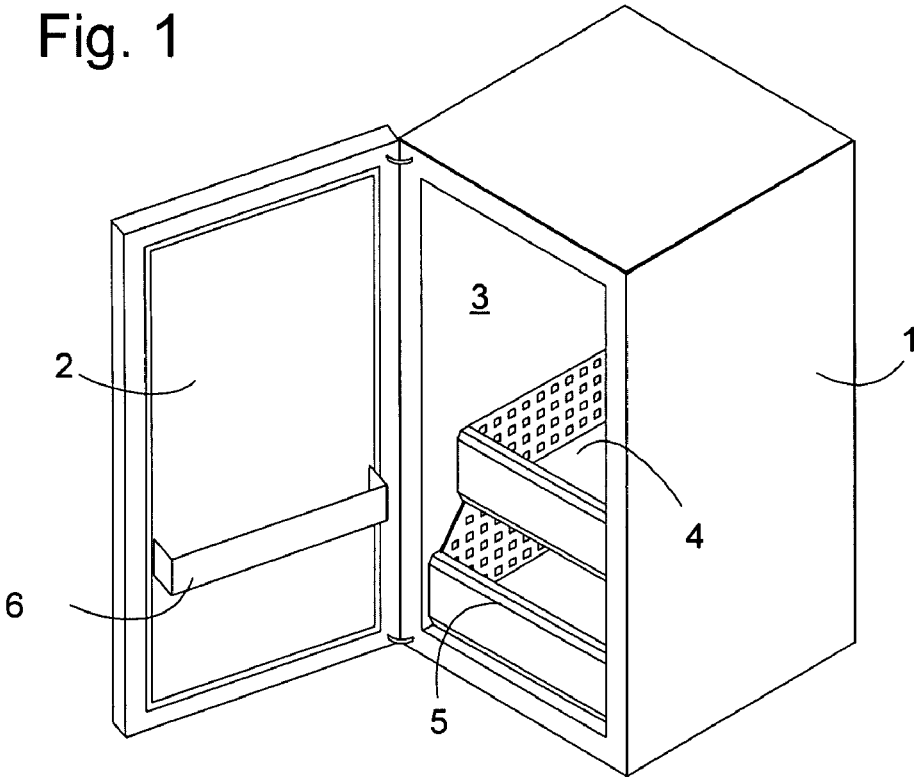
FIG. 1 shows a perspective view of a refrigerator on which the present invention is implemented.

FIG. 1 shows a perspective view of a refrigerator comprising a body 1 and a door 2. Two refrigerated goods carriers 4, 5 in the form of pull-out drawers are illustrated by way of example in a cooling compartment 3 inside the appliance. The pull-out drawers 4, 5 are slidably supported on telescopic extension mechanisms (not visible in the Fig.) suspended from the side walls of the body 1. The upper pull-out drawer 4 is less deep than the lower 5 in order to leave room for a door shelf 6 mounted inside the door 2.

In the upper region of the cooling compartment 3 left empty in the Fig. other shelves can be mounted as required in the form of other pull-out drawers or in the form of stationary or movable plates.

Figure 2:
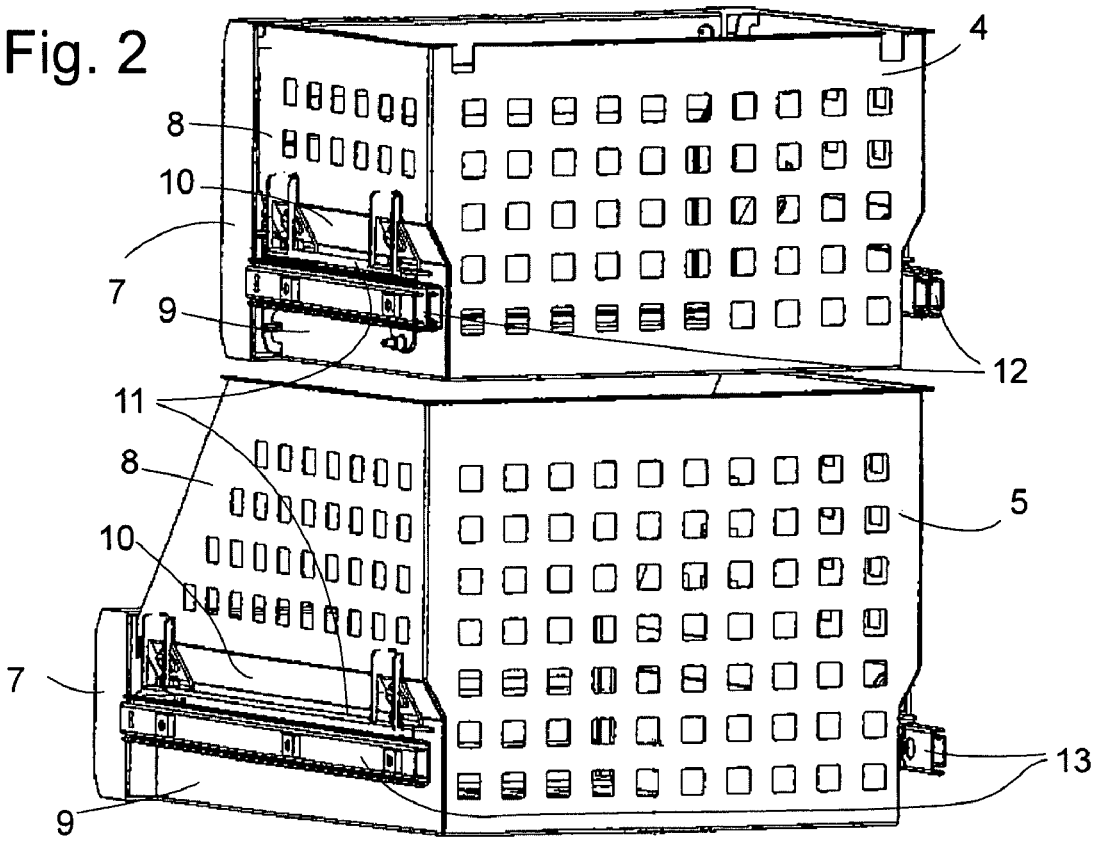
FIG. 2 shows a perspective view of two refrigerated goods carriers of the refrigerator from FIG. 1.

FIG. 2 shows the two pull-out drawers 4, 5 in a perspective view from behind same. The pull-out drawers 4, 5 each comprise a perforated metal basket, the front of which, facing the door, is covered by a plastic faceplate 7. On the upper pull-out drawer 4, said faceplate 7 extends over its entire height, on the lower drawer 5 only over part of its height, so that an access opening is formed between the faceplate 7 and the overlying drawer 4, as illustrated in FIG. 1.

The side walls of the baskets have vertical upper and lower wall sections 8 and 9 respectively with angled shoulders 10 therebetween which run toward one another in the downward direction. To each shoulder 10 is attached a plastic injection-molded carrier section 11 which is more clearly visible in FIGS. 4, 8 and 9. The carrier sections 11 in turn are supported on telescopic extension mechanisms 12 or 13 via adapters.

The telescopic extension mechanisms 13 on which the lower pull-out drawer 5 is supported each have a pair of intermeshing rails. The freedom of movement of said rails relative to one another is between 50 and 80% of their length; here it is equal to the depth of the overlying pull-out drawer 4, so that the pull-out drawer 5, in its fully extended position, is withdrawn completely below the overlying drawer 4 and is freely accessible on its entire upper side.

Figure 3:
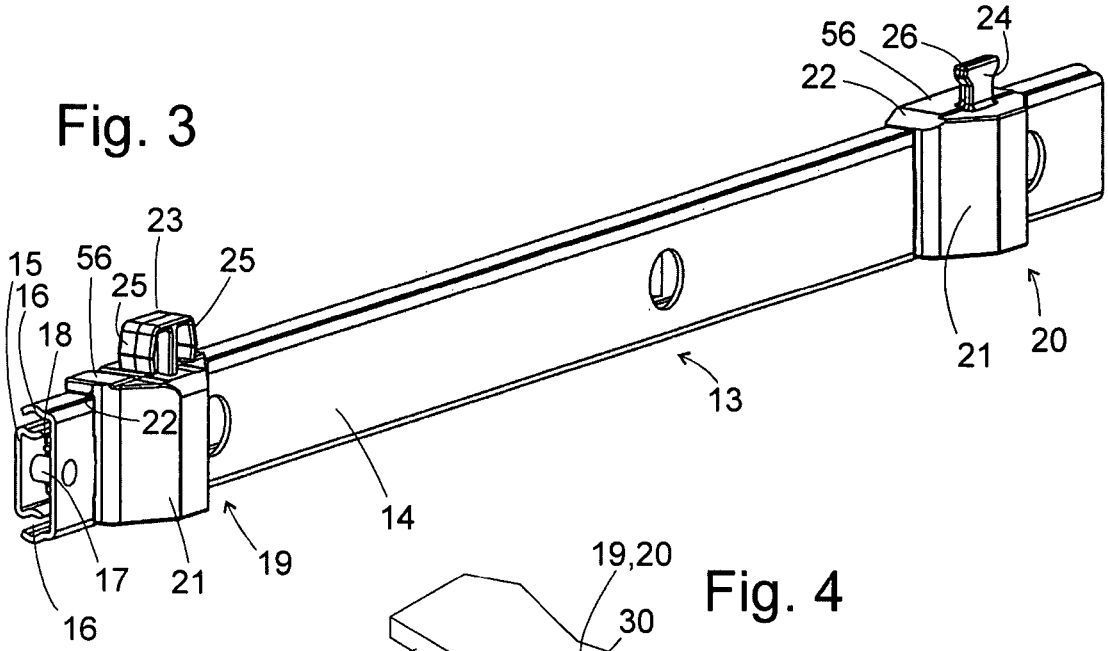
FIG. 3 shows a perspective view of a left-hand telescopic extension mechanism of the lower refrigerated goods carrier.

FIG. 3 shows a perspective view of one of the telescopic extension mechanisms 13 of the lower pull-out drawer 5, namely of the left-hand extension mechanism 13 as viewed looking into the cooling compartment 3. The extension mechanism comprises rails bent from sheet steel, an outer rail 14 of approximately C-shaped cross-section and an inner rail 15 engaging in the cavity of the outer rail 14. Opposing legs of the rails 14, 15 delimit two cylindrical channels 16 in which are accommodated a plurality of balls (not shown in the Fig.) which movably guide the rails 14, 15 relative to one another in a low-play and easy manner. A bolt 17 protrudes from the front end of the outer rail 14 into the intervening space between the rails 14, 15. Its contact with a rubber buffer 18 ((just visible in the Fig.) attached to the inner rail 15 define a limit to the freedom of movement of the rails 14, 15 relative to one another.

A front adapter 19 and a rear adapter 20 made of plastic are attached to the outer rail 14. The adapters 19, 20 are of angular form with an approximately truncated prism shaped vertical arm 21 and a horizontal arm 22 supported on the upper leg of the rail 14.

A latching element 23(24) protrudes from the upper side 56 of the adapter 19(20). The latching element 23 of the front adapter 19 has an approximately T-shaped cross-section, two elastic arms 25 running downward and initially apart from one another and then toward one another again being formed at the ends of the cross-piece of the T. The latching element 24 of the rear adapter 20 is a rigid pin having a forward oriented lug 26 on its upper end.

Figure 4:
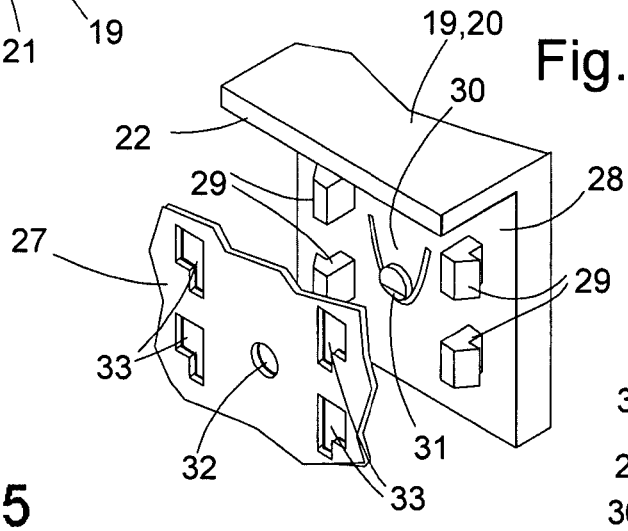
FIG. 4 shows fragments of a telescopic extension mechanism rail and of an adapter which illustrate how the adapter is attached to the rail.

FIG. 4 is intended to illustrate the anchorage of the adapters 19, 20 on the rail 14. It shows, separately from one another in each case, a fragment 27 of the rail 14 and a side of an adapter 19 or 20 facing said fragment, the type of anchorage being the same for the two adapters 19, 20. The adapter wall 28 facing the fragment 27 carries 4 rigid latching hooks 29 and an elastic tongue 30 which is cut out of the wall 28 through a U- or V-shaped slot and from the tip of which a wedge 31 projects. These lie opposite a circular hole 32 and four angular holes 33 of the rail 14, the latter in the form of a rectangle which is elongated by a short slot at its lower edge. To anchor the adapter 19 or 20 to the rail 14, the latching hooks 29 are inserted in the angular holes 33, and simultaneously the tongue 30 whose wedge 31 butts against the closed wall of the rail 14 is forced back into the hollow base body of the adapter. When the latching hooks 29 are pushed completely through the holes 33 and the wall 28 of the adapter lies against the rail 14, the adapter can be pushed down so that the shafts of the latching hooks 29 move into the slots of the holes 33 and the horizontal arm 22 of the adapter comes to lie on the upper leg of the rail 14, the wedge 31 coming up against the circular hole 32 and snapping into same. When this has happened, the adapter can only be released from the rail 14 by first forcing the wedge 31 out of the hole 32 again with a tool and then lifting the adapter.

Figure 5:
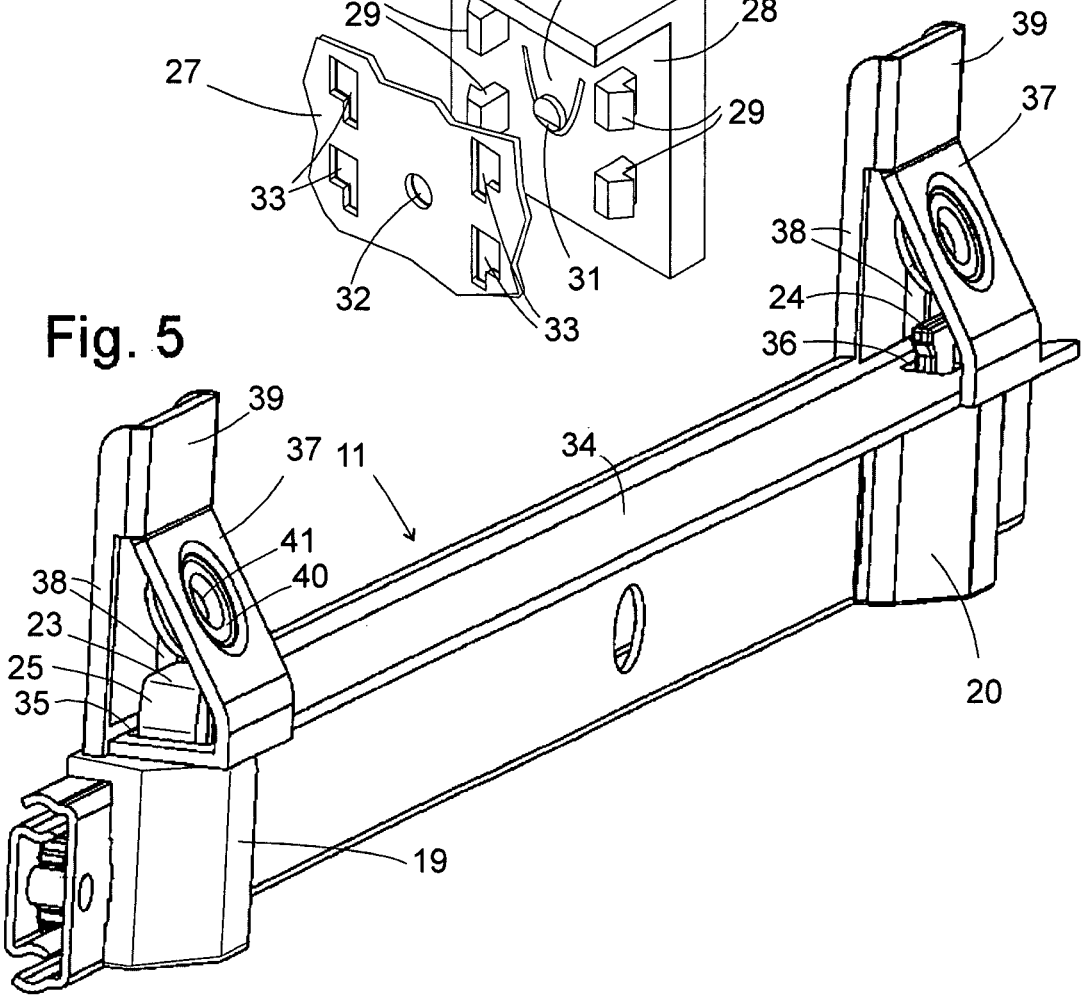
FIG. 5 shows the telescopic extension mechanism from FIG. 3 with carrier section mounted thereon.

FIG. 5 again shows a perspective view of the telescopic extension mechanism 13 from FIG. 3, this time with carrier section 11 latched thereto. The carrier section 11 comprises as elongated base plate 34 which is supported on the upper sides 56 of the adapters 19, 20. On a front end of the base plate 34 there is formed a rectangular hole 35 through which the latching element 23 of the adapter 19 is inserted. The sections extending downward and toward one another of the elastic arms 25 of the latching element 23 press against the front and rear edge of the hole 35, thereby holding the base plate 34 against the upper side 56 of the adapter 19 without play. The pin 24 of the rear adapter 20 engages in a rearwardly open slot 36 of the base plate 34, said base plate 34 being supported on the adapter's upper side 56 by its own weight.

At both ends of the base plate 34, above the hole 35 or the slot 36, there is formed an abutment for the basket of the pull-out drawer 5. The abutment comprises in each case an oblique plate 37, the lower edge of which is connected to an edge of the base plate 34 facing the basket, and the upper edge of which combines with two vertical supports 38 emerging from the base plate 34 to form a U-profile section 39. In the center of the plate 37 there is formed a flat recess 40, in the center of which there is in turn formed a bore 41, widening out to a hexagonal cross-section toward the back of the plate 37.

Figure 6:
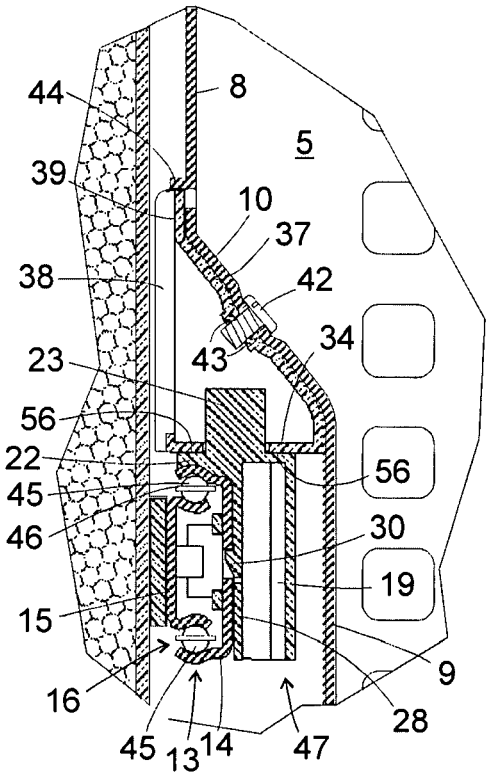
FIG. 6 shows a section through the telescopic extension mechanism of FIGS. 3 and 5 and its environment at adapter level.

FIG. 6 shows a section through the telescopic extension mechanism and its environment at the level of the adapter 19. As this sectional view shows, the bore 41 of the plate 37 serves to attach the basket's shoulder 10 thereto using a screw 42 and a nut 43 accommodated in a form-fit manner in the hexagonal widening of the bore. A clip 44 released from the upper section 8 of the basket side wall is supported against the upper edge of the U-profile section 39.

Also visible in the sectional view are the already mentioned balls 45 which, guided in a cage 46 in a plurality thereof, are mounted in the channels 16 between the rails 14, 15.

It can also be seen that there is located, between the outer rail 14 and the basket's lower wall edge 9 opposite same, an intervening space 47 which is partially filled by the hollow vertical arm 21 of the adapters 19 and 20. The width of this space 47 is greater than that of the telescopic extension mechanism 13, so that it is possible, if required, to accommodate therein a second telescopic extension mechanism without consequently having to alter the dimensions of the pull-out drawer 5.

FIG. 2 shows such an arrangement whereby two linked telescopic extension mechanisms are provided on each side of the upper pull-out drawer 4. These linked telescopic extension mechanisms give the pull-out drawer 4 a freedom of movement that is greater than its depth, so that it can be withdrawn completely below a refrigerated goods carrier (not shown) of the same depth disposed thereabove.

Figure 7:
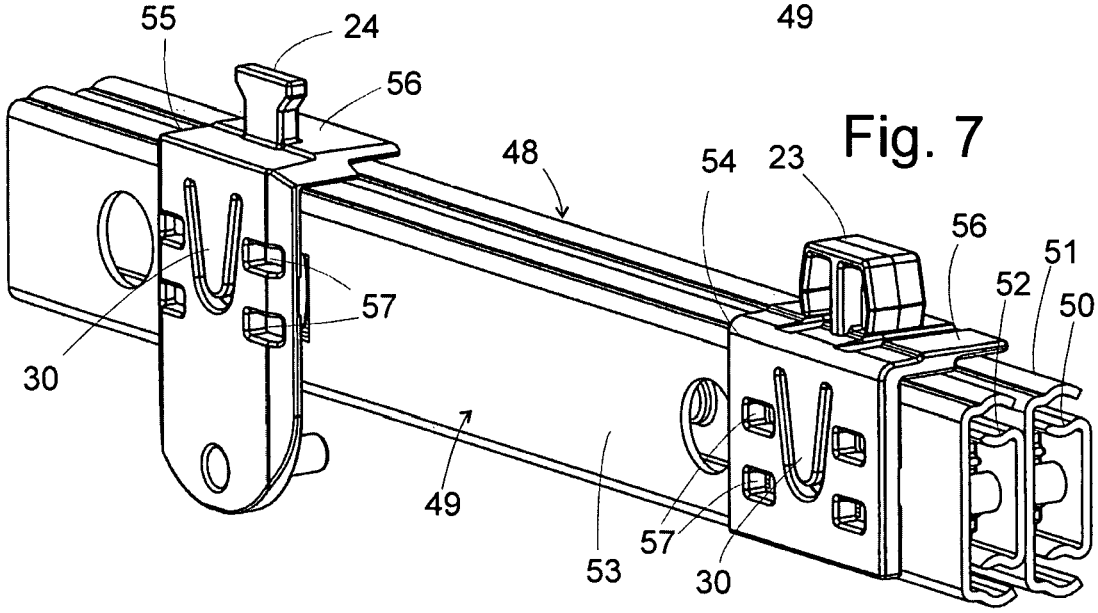
FIG. 7 shows a perspective view of a combined telescopic extension mechanism for the upper refrigerated goods carrier from FIG. 2.

A perspective view of two telescopic extension mechanisms 48, 49 on the right-hand side of the pull-out drawer 4 from the point of view of a user standing in front of the cooling compartment 3 is shown in FIG. 7. The construction of the telescopic extension mechanisms 48, 49 with an inner rail 50 or 52 and an outer rail 51 or 53 which are movably guided relative to one another using balls 45 is the same as for the telescopic extension mechanism 13 and therefore does not need to be explained again. The rails 51, 52 are rigidly interconnected by rivets 58 shown in FIG. 10, one or the other of which can simultaneously be used as a stop for limiting the freedom of movement of the extension mechanisms 48, 49.

The front and rear adapter 54, 55 are anchored to the rail 53 in similar fashion, as described above with reference to FIG. 4. Instead of a broad hollow vertical arm as in the case of the adapters 19, 20 there is here provided only a narrow plate-shaped arm on whose visible side the elastic tongue 30 and cutouts 57 opposite the latching hooks 29 can be seen. The latching elements 23, 24 carried by the adapters 54, 55 are the same as for the adapters 19, 20. Therefore, as can be seen in FIGS. 8, 9, the same kind of carrier section 11 can be mounted on these adapters 54, 55 as already explained with reference to FIG. 5.

Figure 8:
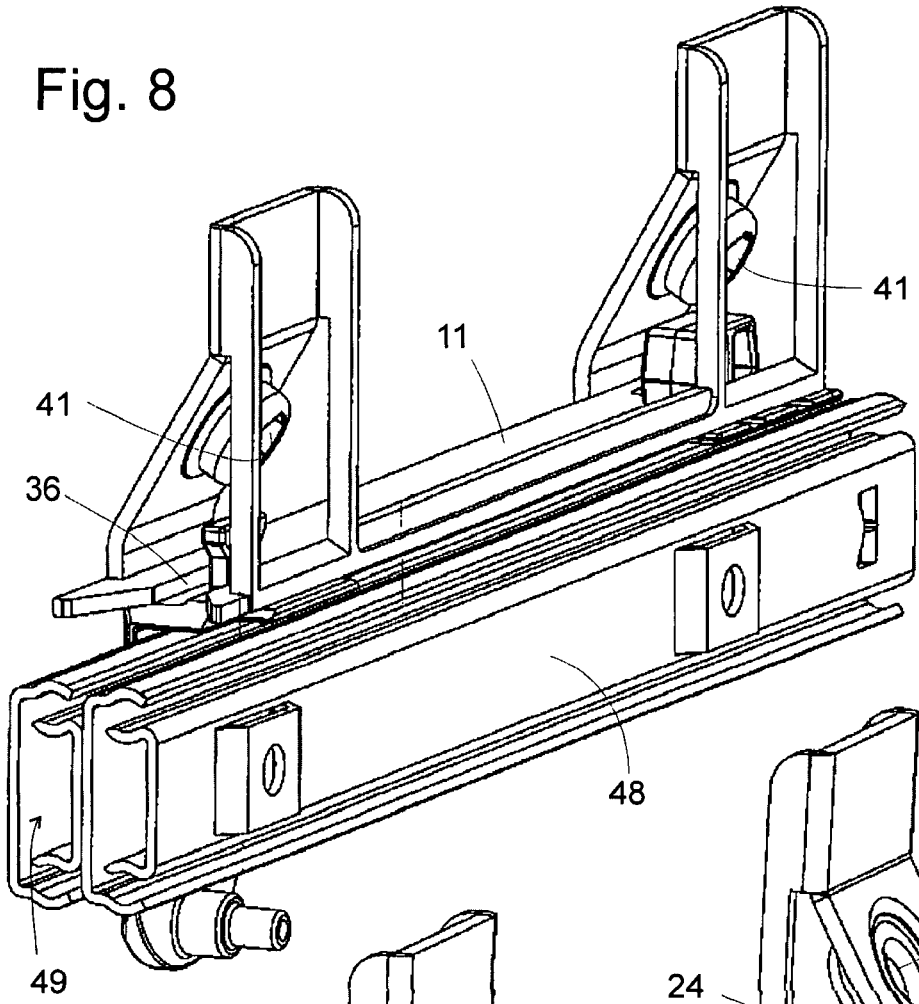
FIG. 8 shows the combined telescopic extension mechanism from FIG. 7 with carrier section mounted thereon, viewed from its side facing the cabinet wall.
Figure 9:
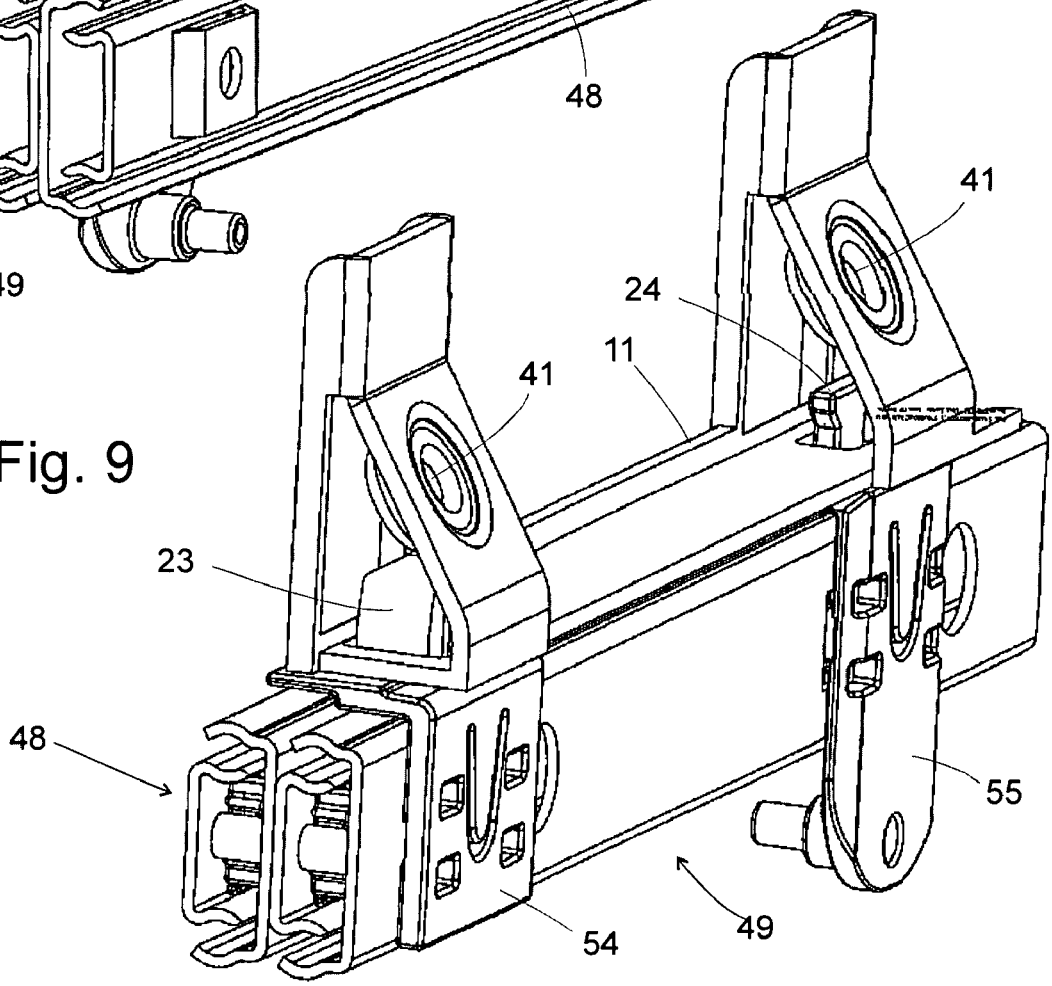
FIG. 9 shows a perspective view of the combined telescopic extension mechanism and of the carrier section, viewed from the cooling compartment of the refrigerator.

In the view in FIG. 8, which shows the side of the telescopic extension mechanisms 48, 49 and carrier section 11 facing the side wall of the body 1, the hexagonal widening of the bores 41 and the slot 36 backwardly open toward the rear wall of the body 1 is particularly visible in the base plate 34 of the carrier section 11. The slot has edges running apart toward the rear end of the base plate 34 in order to facilitate the placing of the slot onto the latching element 24 of the rear adapter.

Figure 10:
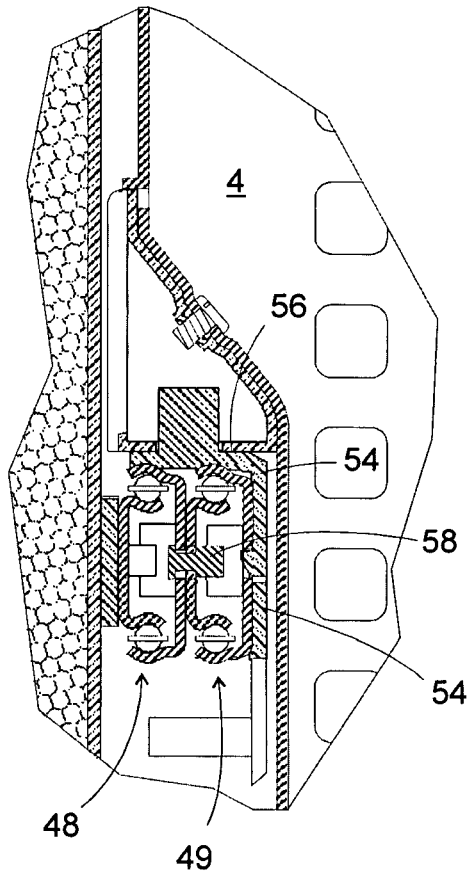
FIG. 10 shows a section as in FIG. 5 through the combined telescopic extension mechanism and its environment at adapter level.

As can be seen in FIG. 10, due to the additional telescopic extension mechanism 49 and the plate-like base body of the adapters 54, 55, the intervening space 47 alongside the wall section 9 of the basket is practically filled up. While in the case of the adapters 19, 20 the latching projections 23, 24 lie essentially perpendicular in extension of the vertical arm 21, in the case of the adapters 54, 55 they are essentially located above the rail 53. The position of the latching projections 23 and 24 in relation to the side wall of the body or the extension mechanism 48 mounted directly thereon is the same as in FIG. 6, so that identical carrier sections 11 and baskets can be supported as required on a single extension mechanism such as 13 or a double extension mechanism such as 48, 49.

The invention claimed is:

1. A refrigerator comprising:

a.) a cooling compartment;

b.) a first refrigerated goods carrier movable between an extended disposition in which the first refrigerated goods carrier is extended at least partially out of the cooling compartment and a retracted disposition is more fully disposed in the cooling compartment than in its extended disposition;

c.) a pair of telescopic extension mechanisms that support the first refrigerated goods carrier for movement between its extended disposition and its retracted disposition, each of the telescopic extension mechanisms having a side that is adjacent a respective side of the other of the telescopic extension mechanisms and the telescopic extension mechanisms being movable relative to one another during movement of the first refrigerated goods carrier between its extended disposition and its retracted disposition; and d.) at least one adapter disposed adjacent to a side of the telescopic extension mechanisms, the at least one adapter supporting the first refrigerated goods carrier on at least one of the telescopic extension mechanisms and the at least one adapter includes a contact surface of the adapter disposed above the level of the telescopic extension mechanisms, wherein the at least one adapter includes a front latching element and a rear latching element, with the rear latching element operable to be latched with a respective complementary latching element of the first refrigerated goods carrier via a movement essentially in parallel to the direction of extension movement of the first refrigerated goods carrier and the front element operable to be latched with a respective complementary latching element of the first refrigerated goods carrier via a movement essentially perpendicular to the direction of extension movement of the first refrigerated goods carrier.

2. The refrigerator as claimed in claim 1, wherein at least part of the contact surface of the adapter extends perpendicularly above the telescopic extension mechanism to which it is attached.

3. The refrigerator as claimed in claim 1, wherein at least part of the contact surface of the adapter extends perpendicularly above an intervening space between the refrigerated goods carrier and the telescopic extension mechanism.

4. The refrigerator as claimed in claim 1, wherein the adapter is angular with a vertical arm laterally attached to the telescopic extension mechanism and a horizontal arm forming the contact surface.

5. The refrigerator as claimed in claim 1, wherein the refrigerated goods carrier supported by the adapter overhangs the adapter with one of its lateral edge.

6. The refrigerator as claimed in claim 1, wherein the adapter supports an intermediate carrier which is connected to the refrigerated goods carrier.

7. The refrigerator as claimed in claim 1, wherein the rear latching element of the adapters is a rigid head and the latching element complementary thereto is a slot of the first refrigerated goods carrier, the slot being open in the direction of extension movement of the first refrigerated goods carrier.

8. The refrigerator as claimed in claim 1, wherein the front latching element of the adapter is a head operable to flexibly deform when the complementary latching element is respectively latched or unlatched.

9. The refrigerator as claimed in claim 8, wherein the head of the front latching element has at least one side that is flexible in the direction of extension movement of the first refrigerated goods carrier and which, in the latched state, holds the complementary latching element of the first refrigerated goods carrier pressed against a stop.

10. The refrigerator as claimed in claim 1, wherein the front and the rear latching element is formed on a respective front adapter and a rear adapter of each telescopic extension mechanism.

11. The refrigerator as claimed in claim 10, wherein the front and rear adapters each have a plane of symmetry perpendicular to the direction of extension movement of the first refrigerated goods carrier.

12. The refrigerator as claimed in claim 1, wherein each telescopic extension mechanism includes two rails and the freedom of movement of the two rails movable in relation to one another of each telescopic extension mechanism amounts to less than two thirds of their length.

13. The refrigerator as claimed in claim 1, wherein each refrigerated goods carrier includes a base body and two carrier sections attached to the base body on which the complementary latching elements are formed.

14. The refrigerator as claimed in claim 13, wherein the base body is sheet metal formed and the carrier sections are injection molded parts.

15. The refrigerator as claimed in claim 1, wherein each telescopic extension mechanism includes two rails and the two rails of each telescopic extension mechanism are movably guided relative to one another using linear ball bearings.

* * * * *